US010153574B1

(12) United States Patent
Park et al.

(10) Patent No.: US 10,153,574 B1
(45) Date of Patent: Dec. 11, 2018

(54) FEMALE TERMINAL CAPABLE OF MINIMIZING RESISTANCE AND PREVENTING DETERIORATION OF PERFORMANCE DUE TO FRICTION

(71) Applicants: Hyundai Motor Company, Seoul (KR); Kia Motors Corporation, Seoul (KR); Tyco Electronics AMP Korea Co., Ltd., Gyeongsan, Gyeongsangbuk-Do (KR)

(72) Inventors: Se Hoon Park, Gyeonggi-do (KR); Kun Sung Song, Gyeongsangbuk-do (KR); Kun Teak Lim, Gyeongsangbuk-do (KR); Yeung Moo Bae, Gyeongsangbuk-do (KR)

(73) Assignees: Hyundai Motor Company, Seoul (KR); Kia Motors Corporation, Seoul (KR); Tyco Electronics AMP Korea Co., Ltd., Gyeongsan, Gyeongsangbuk-do (KR)

( * ) Notice: Subject to any disclaimer, the term of this patent is extended or adjusted under 35 U.S.C. 154(b) by 0 days.

(21) Appl. No.: 15/830,889

(22) Filed: Dec. 4, 2017

(30) Foreign Application Priority Data

Oct. 17, 2017 (KR) ..... 10-2017-0134379

(51) Int. Cl.
*H01R 13/187* (2006.01)
*H01R 13/11* (2006.01)
(Continued)

(52) U.S. Cl.
CPC ..... *H01R 13/113* (2013.01); *H01R 4/185* (2013.01); *H01R 13/04* (2013.01); *H01R 13/05* (2013.01);
(Continued)

(58) Field of Classification Search
CPC ..... H01R 13/187; H01R 13/04; H01R 13/05; H01R 13/052; H01R 13/15
(Continued)

(56) References Cited

U.S. PATENT DOCUMENTS 5,624,283 A 4/1997 Hotea
7,556,542 B2 7/2009 Lischeck et al.
(Continued)

FOREIGN PATENT DOCUMENTS

JP 1995-296886 A 11/1995
JP 2002-246092 A 8/2002
(Continued)

*Primary Examiner* — Abdullah Riyami
*Assistant Examiner* — Justin Kratt
(74) *Attorney, Agent, or Firm* — Mintz Levin Cohn Ferris Glovsky and Popeo, P.C.; Peter F. Corless

(57) ABSTRACT

A female terminal into which a male terminal is inserted and electrically connected is provided. The female terminal includes a housing having an internal cavity into which the male terminal is inserted and a clip that is bent from an end portion of the housing toward the internal cavity and extended in a length direction in which the male terminal is inserted. The clip has a region electrically connected to the male terminal. A plurality of cut apertures are formed in the length direction in a region of the clip at least in contact with the male terminal to be spaced apart from each other in a width direction. Accordingly, the clip and the male terminal are in contact with each other in a plurality of positions.

8 Claims, 7 Drawing Sheets

(51) Int. Cl.

| | |
|---|---|
| ***H01R 4/18*** | (2006.01) |
| *H01R 13/05* | (2006.01) |
| *H01R 13/04* | (2006.01) |
| *H01R 13/15* | (2006.01) |

(52) U.S. Cl.
CPC ..... *H01R 13/052* (2013.01); *H01R 13/15* (2013.01); *H01R 13/187* (2013.01)

(58) Field of Classification Search
USPC ..... 439/845, 849, 850, 851, 852
See application file for complete search history.

(56) References Cited

U.S. PATENT DOCUMENTS

| | | | | |
|---|---|---|---|---|
| 9,509,069 | B2 | 11/2016 | Komiyama et al. | |
| 2013/0157523 | A1* | 6/2013 | Hara | H01R 13/05 439/867 |
| 2015/0133004 | A1* | 5/2015 | Uno | H01R 13/113 439/867 |

FOREIGN PATENT DOCUMENTS

| | | | |
|---|---|---|---|
| JP | 2006-0172732 | A | 6/2006 |
| KR | 2009-0060793 | A | 6/2009 |

* cited by examiner

FEMALE TERMINAL CAPABLE OF MINIMIZING RESISTANCE AND PREVENTING DETERIORATION OF PERFORMANCE DUE TO FRICTION

CROSS REFERENCE TO RELATED APPLICATION

The present application claims priority to Korean Patent Application No. 10-2017-0134379, filed Oct. 17, 2017, the entire contents of which is incorporated herein for all purposes by this reference.

BACKGROUND

1. Technical Field of the Disclosure

The present disclosure relates to a female terminal, and more particularly, to a female terminal configured to receive a male terminal and is electrically connected thereto.

2. Description of the Related Art

Recently, various electronic devices are being mounted within a vehicle, and the number of connectors, connecting circuits, cables, and the like, of the various electric devices has rapidly increased. Generally, a vibration is inevitably generated in a vehicle in which an internal combustion engine is mounted, and vibration friction is generated at a terminal connection portion between a male terminal having a bar shape and a female terminal having a pipe shape by the vibration. Tin has been plated on electrodes of an electrical connecting member to prevent corrosion of the electrodes. However, when friction is generated between two electrodes by the vibration, a tin plating layer generates fine tin particles while being separated from the electrodes. Accordingly, the fine tin particles are oxidized by oxygen in the air and are thus changed into tin oxides. The tin oxides are insulating materials and when the tin oxides accumulate between the two electrodes, an insulating tin oxide film is resultantly formed between the two electrodes.

When the insulating tin oxide film as described above is expanded to a predetermined thickness or area instantaneously when a short-circuit occurs in the two electrodes or decreases a contact area between the two electrodes to increase electric resistance. When a surface of the electrode that appears smooth is magnified, the surface of the electrode is a rough surface having irregular peaks and valleys. Therefore, the contact area between the two electrodes is decreased and the resistance is increased. A new connector structure capable of suppressing separation of tin particles and formation of the oxide film due to the friction and increasing the contact area between the electrodes to decrease the resistance, particularly, a structure of a new female connector is necessary.

The contents described as the related art have been provided merely for assisting in the understanding for the background of the present disclosure and should not be considered as corresponding to the related art known to those skilled in the art.

SUMMARY

The present disclosure provides a female terminal capable of minimizing resistance and preventing deterioration of performance due to friction.

In an aspect of an exemplary embodiment of the present disclosure a female terminal configured to receive a male terminal therein and electrically connected thereto may include a housing having an internal cavity into which the male terminal is inserted and a clip bent from an end portion of the housing toward the internal cavity and extended in a length direction in which the male terminal is inserted, and having a region electrically connected to the male terminal. A plurality of cut apertures may be formed in the length direction in a region of the clip in contact with the male terminal to be spaced apart from each other in a width direction, to dispose the clip and the male terminal to be in contact with each other in a plurality of positions.

In some exemplary embodiments, the clip may be divided into a coupling portion, an elastic portion, a fixing portion, a contact portion, and a distal end portion sequentially from the end portion of the housing in the length direction, and the elastic portion may elastically intermediate between the coupling portion and the fixing portion to move the fixing portion, the contact portion, and the distal end portion in the length direction. A cross section of the contact portion in the width direction may be formed in a shape bent to be convex in a downward direction. The contact portion may be divided into a plurality of terminals in the width direction by the cut apertures, and the terminals may be individually in contact with the male terminal.

In an exemplary embodiment, the contact portion may satisfy the following Equations 1 and 2:

$$S \geq 0.2 \times t \qquad \text{Equation 1:}$$

$$H \geq t \qquad \text{Equation 2:}$$

Wherein S is a width of each of the terminals, H is a width of each of the cut apertures, and t is a thickness of the contact portion.

The contact portion may include three terminals partitioned by two cut apertures.

The elastic portion may satisfy the following Equation 3:

$$F \geq 1.1 \times E \qquad \text{Equation 3:}$$

Wherein F is a static friction force between the male terminal and the contact portion, and E is an elastic force of the elastic portion when the elastic portion is maximally deformed.

In other exemplary embodiments, the elastic portion may be formed in a zigzag shape in the width direction, and may be configured to move the fixing portion, the contact portion, and the distal end portion in the length direction while being extended or contracted in the length direction based on movement of the male terminal. A fixing aperture vertically penetrating through the clip may be formed in the fixing portion. A fixing pin that protrudes from an interior surface of the housing toward the internal cavity and inserted into the fixing aperture may be formed in the housing. The fixing aperture may be formed at a size greater than a size of the fixing pin.

A first support piece protruding from the interior surface of the housing toward the internal cavity to support a lower portion of the fixing portion may be formed in the housing. A second support piece protruding from the interior surface of the housing toward the internal cavity to support a lower surface of the distal end portion may be formed in the housing.

BRIEF DESCRIPTION OF THE DRAWINGS

The above and other objects, features and advantages of the present disclosure will be more clearly understood from the following detailed description taken in conjunction with the accompanying drawings, in which.

DETAILED DESCRIPTION

Figure 1:
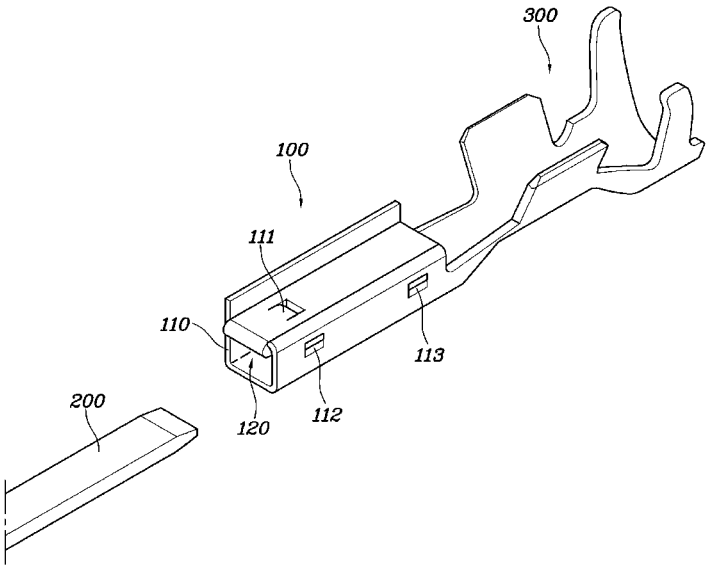
FIG. 1 is an exemplary perspective view illustrating a female terminal according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Terminologies used herein are to mention only a specific exemplary embodiment, and are not to limit the present disclosure. Singular forms used herein include plural forms as long as phrases do not clearly indicate an opposite meaning. A term "including" used in the present specification concretely indicates specific properties, regions, integer numbers, steps, operations, elements, and/or components, and is not to exclude presence or addition of other specific properties, regions, integer numbers, steps, operations, elements, components, and/or a group thereof.

All terms including technical terms and scientific terms used herein have the same meaning as the meaning generally understood by those skilled in the art to which the present disclosure pertains unless defined otherwise. Terms defined in a generally used dictionary are additionally interpreted as having the meaning matched to the related art document and the currently disclosed contents and are not interpreted as ideal or formal meaning unless defined.

Figure 2:
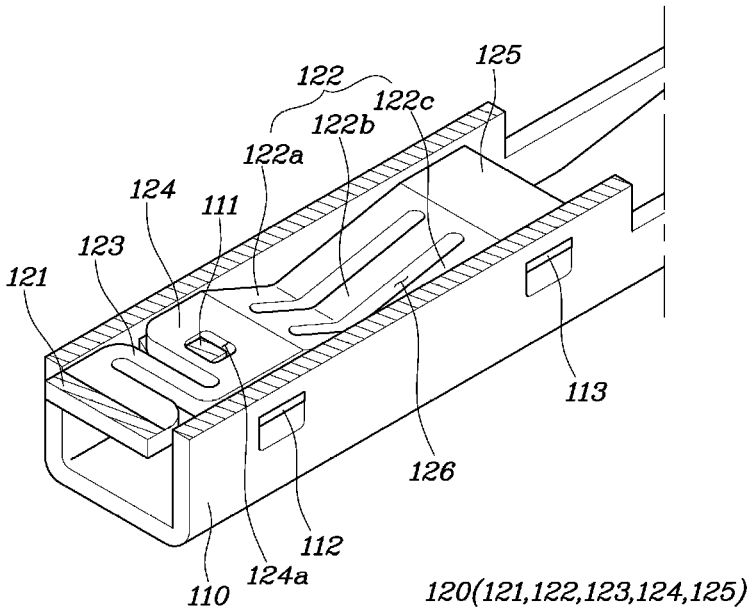
FIG. 2 is an exemplary plan cut-away perspective view illustrating the female terminal according to an exemplary embodiment of the present disclosure.
Figure 3:
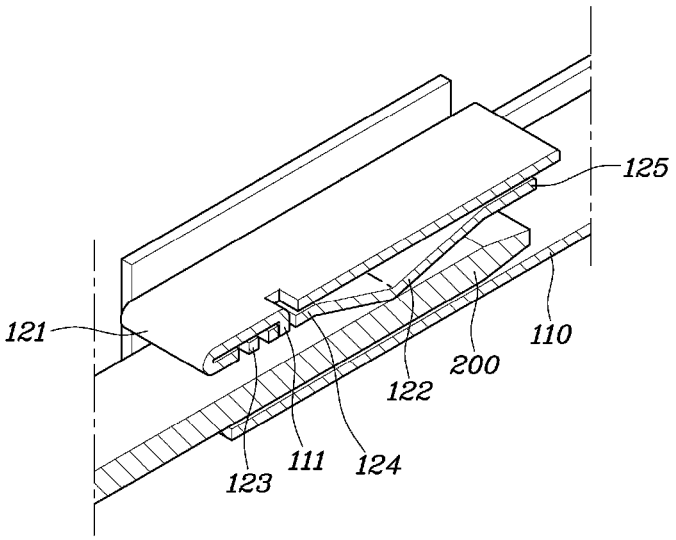
FIG. 3 is an exemplary side cut-away perspective view illustrating the female terminal according to an exemplary embodiment of the present disclosure.

Hereinafter, a female terminal according to an exemplary embodiment of the present disclosure will be described with reference to the accompanying drawings. FIG. 1 is an exemplary perspective view illustrating a female terminal according to an exemplary embodiment of the present disclosure. FIG. 2 is an exemplary plan cut-away perspective view illustrating the female terminal according to an exemplary embodiment of the present disclosure. FIG. 3 is an exemplary side cut-away perspective view illustrating the female terminal according to an exemplary embodiment of the present disclosure.

As illustrated in FIGS. 1 to 3, the female terminal 100 according to the present disclosure may be mainly divided into a housing 110 and a clip 120. Hereinafter, a length direction refers to a direction in which a male terminal 200 is inserted or separated, and a width direction refers to a direction perpendicular to the length direction and parallel with a surface on which the clip 120 and the male terminal 200 may be in contact with each other.

The housing 110 may be a component having a shape of a type of pipe with an internal cavity into which the male terminal 200 is inserted, and may be formed in a rectangular pipe shape by way of example. The male terminal 200 may be inserted into the housing 110 at a first end of the housing 110, and a connection terminal 300 for connection to an electric wire may be extended from a second end of the housing 110. The housing 110 may be integrally formed with the connection terminal 300 or may be formed as a component separate from the connection terminal 300 to have a separate coupling structure. The housing 110 and the connection terminal 300 may be formed of a conductor such as copper, aluminum, or the like.

As described in detail below, a fixing pin 111, a first support piece 112, and a second support piece 113 protruding from an interior surface of the housing 110 toward the internal cavity may be formed in the housing 110. Installation positions and coupling relationships of the fixing pin 111, the first support piece 112, and the second support piece 113 will hereinafter be described together with a description for the components.

The clip 120 may be extended from the first end of the housing 110, and may be bent toward the internal cavity of the housing 110 and formed to be elongated in the length direction in which the male terminal 200 is inserted, and may be in contact with and electrically connected to the male terminal 200. For example, a plurality of cut apertures 126 may be formed in the length direction in a region of the clip 120 in contact with the male terminal 200 to be spaced apart from each other in the width direction. The clip 120 and the male terminal 200 may be in contact with each other in a plurality of positions. The clip 120 will be described in more detail. The clip 120 may be extended from the first end of the housing 110 and be divided into a coupling portion 121, an elastic portion 123, a fixing portion 124, a contact portion 122, and a distal end portion 124 sequentially in the length direction.

The coupling portion 121 that supports the entirety of the clip 120 may be extended from the first end of the housing 110 and may form a first end portion of the clip 120. The elastic portion 123, the fixing portion 124, the contact portion 122, and the distal end portion 125, that form the additional portions of the clip 120, are not directly connected to the housing 110 or other components and may be extended from and supported by the coupling portion 121. The coupling portion 121 may be extended from an end portion of the housing 110 and may be bent toward the internal cavity of the housing 110 and may be formed to have a cross-sectional shape similar to a C shape. However, a specific shape of the coupling portion 121 is not particularly limited provided the coupling portion 120 may serve as a starting point supporting the entirety of the clip 120.

The elastic portion 123, which is a component elastically intermediating between the coupling portion 121 and the fixing portion 124, may be formed in a zigzag shape in the width direction to have a predetermined gap formed in the length direction. The elastic portion 123 may be deformed when the gap is expanded or narrowed while being extended or contracted in the length direction, and the fixing portion 124, the contact portion 122, and the distal end portion 125 may be configured to move in the length direction. However, when the elastic portion 123 is required to support the other portions of the clip 120 except for the coupling portion 121, (e.g., the fixing portion 124, the contact portion 122, and the distal end portion 125), the elastic portion 123 may be formed at a predetermined thickness in the length direction to maintain minimum rigidity together with elastic force. A specific thickness of the elastic portion 123 may be changed based on a material of the clip 120 or a size and a form of the terminal it is not particularly limited in the present disclosure.

The elastic portion 123 may be formed to satisfy the following Equation 3.

$$F \geq 1.1 \times E \qquad \text{Equation 3:}$$

Wherein, F static friction force between the male terminal and the contact portion, and E is elastic force of the elastic portion when the elastic portion is maximally deformed.

When Equation 3 is satisfied, the static friction force may be greater than the maximum elastic force. Therefore, when a relative vibration is generated between the male terminal 200 and the female terminal 100, the elastic portion 123 may be deformed before friction between the male terminal 200 and the contact portion 122 may be generated, thereby preventing the generation of the friction.

When the static friction force descried above is less than 1.1 times of the maximum elastic force, the generation of the friction may not be effectively suppressed. A fixing aperture 124*a* into which the fixing pin 111 protruding from the interior surface of the housing 110 is inserted may be formed in the fixing portion 124, and the fixing aperture 124*a* may be formed at a size greater than that of the fixing pin 111. Accordingly the fixing pin 111 may be movably formed in the fixing aperture 124*a*. The fixing pin 111 may be extended from the housing 110, to maintain a position of the fixing pin 111. Therefore, when the elastic portion 123 of the clip 120 is deformed in the length direction, the fixing pin 111 may limit a deformation amount of the elastic portion 123 while being captured by an interior surface of the fixing aperture 124*a*.

In particular, a length of the fixing aperture 124*a* in the length direction may be greater than that of the fixing pin 111 in the length direction and a length of the fixing aperture 124*a* in the width direction may be equal to or greater than that of the fixing pin 111 in the width direction. Accordingly, interference may be prevented from being generated when the fixing pin 111 moves in the length direction of the fixing aperture 124*a*. A difference between the lengths of the fixing aperture 124*a* and the fixing pin 111 in the length direction may be greater than a length of the relative vibration generated between the male terminal 200 and the female terminal 100. When the difference between the lengths of the fixing aperture 124*a* and the fixing pin 111 in the length direction is less than the length of the relative vibration, the elastic portion 123 may not prevent the friction due to the vibration. A cross section of the contact portion 122 in the width direction may have a shape similar to a V shape bent to be convex in a downward direction. Through such a structure, a vertex portion of the contact portion 122 having the V shape, that is, a contact point 130 may be in contact with and may be electrically connected to the male terminal 200 when the male terminal 200 is inserted into the housing 110.

Additionally, the contact portion 122 may be divided into a plurality of terminals 122*a*, 122*b*, and 122*c* partitioned by the plurality of cut apertures 126. For example, a first terminal 122*a*, a second terminal 122*b*, and a third terminal 122*c* may be partitioned by two cut apertures 126. The plurality of terminals 122*a*, 122*b*, and 122*c* constituting the contact portion 122 as described above may be separately in contact with the male terminal 200. In particular, the respective terminals 122*a*, 122*b*, and 122*c* of the contact portion 122 and the cut apertures 126 may be formed to satisfy the following Equations 1 and 2.

$$S \geq 0.2 \times t \qquad \text{Equation 1:}$$

$$H \geq t \qquad \text{Equation 2:}$$

Wherein, S is a width of each of the terminals, H is a width of each of the cut apertures, and t is a thickness of the contact portion. The contact portion may include three terminals partitioned by the two cut apertures.

Equation 1 may be condition limiting a width of each of the terminals 122*a*, 122*b*, and 122*c*, and Equation 2 may be a condition limiting a width of each of the cut apertures 126. When Equation 1 is not satisfied, the width of each of the terminals 122*a*, 122*b*, and 122*c* may be narrow to decrease the rigidity of each of the terminals. When Equation 2 is not satisfied, a process for forming the cut apertures 126 may be more difficult may increase the incident of a process defects. For example, when a semi-finished product for manufacturing the female terminal is cast, cores inserted into positions of the cut apertures 126 may be damaged and the cut apertures 126 may not be formed. The widths of the terminals 122*a*, 122*b*, and 122*c* and the cut apertures 126 of Equations 1 and 2 may refer to FIG. 7.

Figure 4:
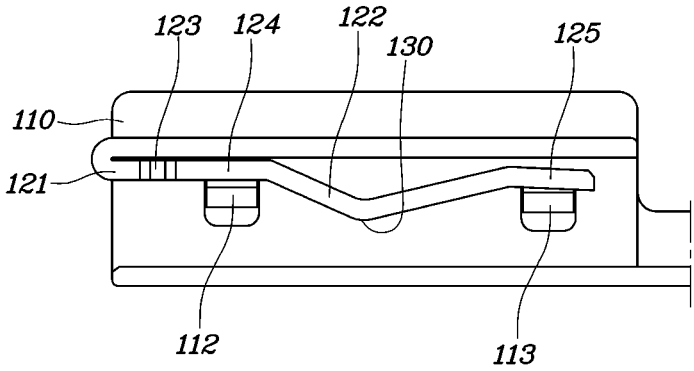
FIG. 4 is an exemplary side view illustrating the female terminal according to an exemplary embodiment of the present disclosure.

FIG. 4 is an exemplary side view illustrating the female terminal according to an exemplary embodiment of the present disclosure. As illustrated in FIGS. 3 and 4, the first support piece 112 and the second support piece 113 may be formed in the housing 110. The first support piece 112 may be a component that protrudes from the interior surface of the housing 110 toward the internal cavity to support a lower portion of the fixing portion 124. The second support piece 113 may be a component that protrudes from the interior surface of the housing 110 toward the internal cavity to support a lower surface of the distal end portion 125.

The first support piece 112 and the second support piece 113 may be formed to prevent the clip 120 from being disposed in the downward direction by a self-weight. When the male terminal 200 is inserted into the housing 110, the male terminal 200 supports the clip 120, more specifically, the contact portion 122, but the coupling portion 121 may be requited to withstand the entire load of the clip 120 when the male terminal 200 is not inserted into the housing 110 therefore the clip 120 may be disposed in the downward direction by the self-weight. When the clip 120 is disposed in the downward direction as described above, the male terminal 200 may be obstructed upon insertion into the housing 110 and a structure preventing to prevent the clip 120 disposed in the downward direction is requited. Therefore, the first support piece 112 may support a lower end of the fixing portion 124, and the second support piece 113 may support a lower end of the distal end portion 125, to prevent the clip 120 being disposed in the downward direction due to the self-weight.

Hereinafter, an operation relationship and an effect of the female terminal according to the present disclosure will be described. As illustrated in FIGS. 1 to 4, the female terminal 100 according to the present disclosure may prevent generation of an oxide film, for example, a tin oxide due to generation of friction at a contact portion between the male terminal 200 and the female terminal 100 when the relative vibration is generated between the male terminal 200 and the female terminal 100 upon insertion of the male terminal 200 into the housing 110.

When the relative vibration is generated between the male terminal 200 and the female terminal 100 after the male terminal 200 is inserted into the housing 110 to be in contact with the contact portion 122, the elastic portion 123 may be configured to absorb the relative vibration while being deformed in the length direction. The male terminal 200 and the contact point of the contact portion 122 may be maintained in predetermined positions to prevent friction from being generated.

Figure 5:
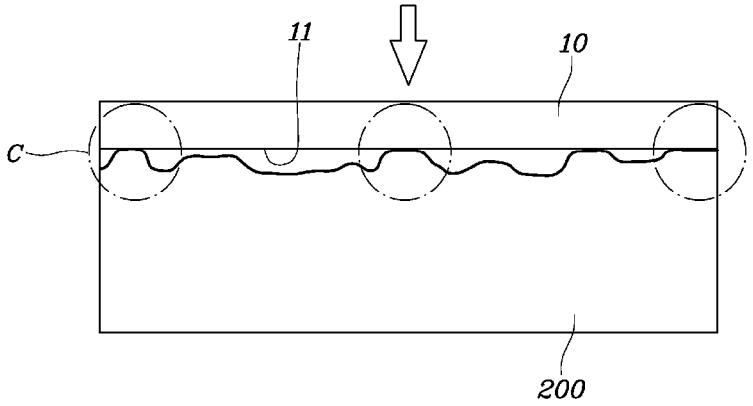
FIG. 5 RELATED ART
FIG. 5 is an exemplary enlarged view illustrating a contact portion between a male terminal and a female terminal according to the related art.
Figure 6:
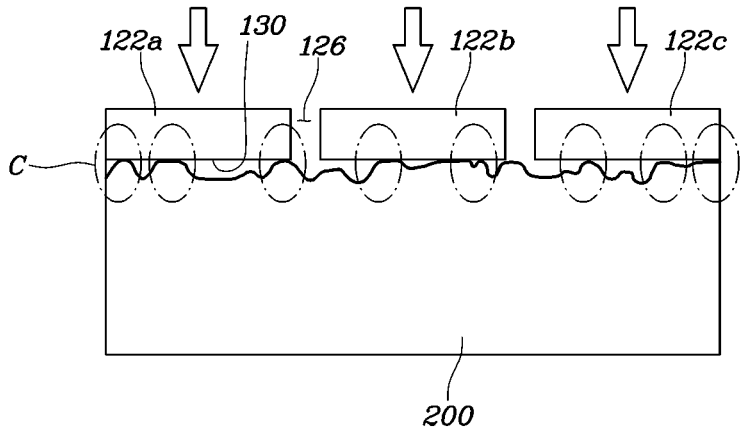
FIGS. 6 and 7 are exemplary detailed views illustrating a contact portion between a male terminal and the female terminal according to an exemplary embodiment of the present disclosure.
Figure 7:
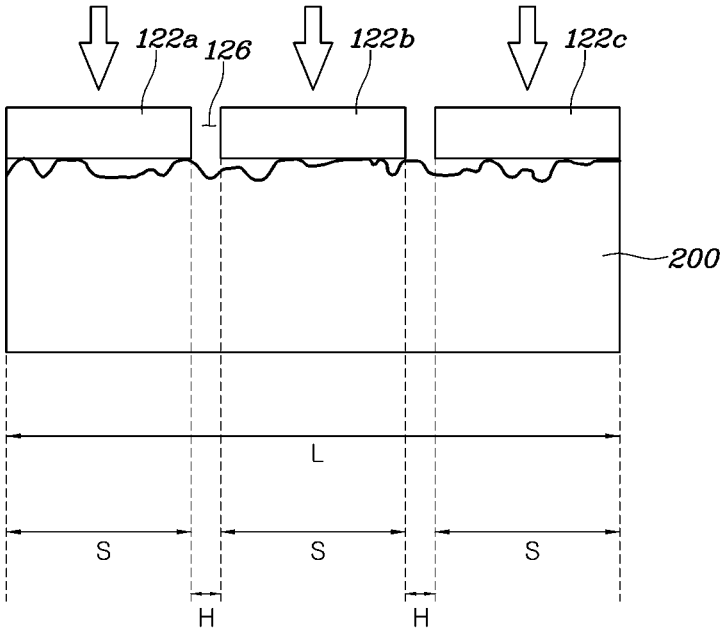

FIG. 5 is an exemplary detailed view illustrating a contact portion between a male terminal and a female terminal according to the related art. FIGS. 6 and 7 are exemplary enlarged views illustrating a contact portion between a male terminal and the female terminal according to an exemplary embodiment of the present disclosure. A surface contact may generally indicate that two surfaces that are flatly processed are in contact with each other. However, even though the processed surfaces are viewed to be flat, it may be appreciated that numerous irregularities are formed when the processed surfaces are enlarged using a microscope. Therefore, a surface-contact between the two surfaces, which is a contact between protrusion portions formed on the respective surfaces, is substantially a set of numerous point-contacts.

As illustrated in FIG. 5, in the related art, a contact portion 10 of the female terminal 100 is formed of one plate, such that a width of the terminal 11 of the contact portion 10 and a width of the male terminal 200 are the same as each other. When, the number of contact points C at which the terminal 11 and the female terminal 100 are substantially in contact with each other is reduced a total contact area is decreased, and contact resistance is thus increased.

As illustrated in FIGS. 6 and 7, in the female terminal 100 according to the present disclosure, the contact portion 122 may include the plurality of terminals 122*a*, 122*b*, and 122*c* to dispose the number of contact points C at which the terminals 122*a*, 122*b*, and 122*c* of the contact portion 122 and the male terminal 200 are substantially in contact with each other may be relatively large. When the plurality of terminals 122*a*, 122*b*, and 122*c* less than a length L of the male terminal 200 in the width direction are in contact with the male terminal 200, an apparent contact area may be decreased, but a substantial contact area may be increased. Therefore, a total contact area between the contact portion 122 and the male terminal 200 may be increased and the contact resistance may be decreased.

The female terminal according to the present disclosure has the following effects. The substantial contact area may be increased to decrease the contact resistance between the terminals. The friction between the terminals due to the vibration may be reduced to suppress the insulating oxide film from being formed. A moving distance of the elastic portion absorbing the vibration may be limited to suppress deformation of the elastic portion beyond an elastic limit. Additionally, a terminal structure according to the related art may be used.

Although exemplary embodiments of the present disclosure has been described with reference to the accompanying drawings, those skilled in the art will appreciate that various modifications and alterations may be made without departing from the spirit or essential feature of the present disclosure. It is to be understood that the scope of the present disclosure will be defined by the claims rather than the above-mentioned description and all modifications and alternations derived from the claims and their equivalents are included in the scope of the present disclosure.

What is claimed is:

1. A female terminal into which a male terminal is inserted and electrically connected, comprising:

a housing having an internal cavity into which the male terminal is inserted; and a clip bent from a first portion of the housing toward the internal cavity and extended in a length direction to receive the male terminal, and having a region electrically connected to the male terminal, wherein a plurality of cut apertures are formed in the length direction in a region of the clip at least in contact with the male terminal to be spaced apart from each other in a width direction, to dispose the clip and the male terminal to be in contact with each other in a plurality of positions, the clip is divided into a coupling portion, an elastic portion, a fixing portion, a contact portion, and a distal end portion sequentially from a second end portion of the housing in the length direction, and the elastic portion elastically intermediates between the coupling portion and the fixing portion to move the fixing portion, the contact portion, and the distal end portion in the length direction, and the elastic portion is formed in a zigzag shape in the width direction and is configured to move the fixing portion, the contact portion, and the distal end portion in the length direction while being extended or contracted in the length direction based on movement of the male terminal.

2. The female terminal of claim 1, wherein a cross section of the contact portion in the width direction is formed in a shape bent to be convex in a downward direction, the contact portion is divided into a plurality of terminals in the width direction by the cut apertures, and the terminals are individually in contact with the male terminal.

3. The female terminal of claim 2, wherein the contact portion satisfies the following Equations 1 and 2:

$$S \geq 0.2 \times t \quad \text{Equation 1:}$$

$$H \geq t \quad \text{Equation 2:}$$

wherein S is a width of each of the terminals, H is a width of each of the cut apertures, and t is a thickness of the contact portion.

4. The female terminal of claim 2, wherein the contact portion includes three terminals partitioned by two cut apertures.

5. The female terminal of claim 3, wherein the elastic portion satisfies Equation 3:

$$F \geq 1.1 \times E \qquad \text{Equation 3:}$$

wherein F is static friction force between the male terminal and the contact portion, and E is elastic force of the elastic portion when the elastic portion is maximally deformed.

6. The female terminal of claim 1, wherein a fixing aperture that vertically penetrates through the clip is formed in the fixing portion, a fixing pin that protrudes from an interior surface of the housing toward the internal cavity and inserted into the fixing aperture is formed in the housing, and the fixing aperture is formed at a size greater than that of the fixing pin.

7. The female terminal of claim 6, wherein a first support piece that protrudes from the interior surface of the housing toward the internal cavity to support a lower portion of the fixing portion is formed in the housing.

8. The female terminal of claim 7, wherein a second support piece protruding from the interior surface of the housing toward the internal cavity to support a lower surface of the distal end portion is formed in the housing.

* * * * *